US012320106B2

(12) United States Patent
Funke et al.

(10) Patent No.: US 12,320,106 B2
(45) **Date of Patent: *Jun. 3, 2025**

(54) SANITARY SYSTEM FOR DISPENSING TREATED LIQUIDS

(71) Applicant: BLANCO GMBH + CO KG, Oberderdingen (DE)

(72) Inventors: Thomas Funke, Eppingen (DE); Olaf Stenvers, Mannheim (DE); Stefan Keller, Zaberfeld (DE)

(73) Assignee: BLANCO GMBH + CO KG, Oberderdingen (DE)

( * ) Notice: Subject to any disclaimer, the term of this patent is extended or adjusted under 35 U.S.C. 154(b) by 228 days.

This patent is subject to a terminal disclaimer.

(21) Appl. No.: 17/979,391

(22) Filed: Nov. 2, 2022

(65) Prior Publication Data

US 2023/0134260 A1 May 4, 2023

(30) Foreign Application Priority Data

Nov. 4, 2021 (DE) ..... 10 2021 212 427.5

(51) Int. Cl.
*E03C 1/05* (2006.01)
*E03C 1/04* (2006.01)

(52) U.S. Cl.
CPC ..... *E03C 1/057* (2013.01); *E03C 1/04* (2013.01); *E03C 2201/40* (2013.01)

(58) Field of Classification Search
CPC ..... E03C 1/057; E03C 1/04; E03C 2201/40
USPC ..... 4/619, 675–678; 137/801
See application file for complete search history.

(56) References Cited

U.S. PATENT DOCUMENTS

| | | | | |
|---|---|---|---|---|
| 9,739,040 | B2 | 8/2017 | Gnauert et al. | |
| 11,584,630 | B2 * | 2/2023 | Funke | E03C 1/055 |
| 11,702,329 | B2 * | 7/2023 | Funke | E03C 1/055 99/275 |
| 2017/0254055 | A1 | 9/2017 | Xia | |
| 2019/0270630 | A1 | 9/2019 | Dahan et al. | |
| 2020/0123744 | A1 | 4/2020 | Keel et al. | |
| 2021/0017010 | A1 | 1/2021 | Funke et al. | |

FOREIGN PATENT DOCUMENTS

| | | | | |
|---|---|---|---|---|
| DE | 10 2013 000 773 | | 7/2014 | |
| DE | 10 2013 002 236 | | 8/2014 | |
| DE | 10 2018 126 214 | | 4/2020 | |
| DE | 10 2019 210 435 | | 1/2021 | |
| EP | 3 533 937 | | 9/2019 | |
| EP | 3 766 828 | | 1/2021 | |
| WO | WO-2006058650 | A1 * | 6/2006 | E03C 1/04 |
| WO | 2016/040986 | | 3/2016 | |

* cited by examiner

*Primary Examiner* — Tuan N Nguyen
(74) *Attorney, Agent, or Firm* — Wenderoth, Lind & Ponack, L.L.P.

(57) ABSTRACT

A sanitary system includes a sanitary faucet and a control device. The sanitary faucet includes: (i) a first control element for setting a quantity of a liquid to be dispensed; (ii) a second control element for setting a type of the liquid to be dispensed; and (iii) a display device including optical display elements. The control device is connected to the first control element, the second control element and the display device. The control device is programmed to control the display device to display control element settings by separate actuation of the optical display elements.

20 Claims, 4 Drawing Sheets

SANITARY SYSTEM FOR DISPENSING TREATED LIQUIDS

BACKGROUND OF THE INVENTION

1. Field of the Invention

The invention relates to a sanitary fitting for dispensing treated liquids, comprising a first control element for setting a quantity of a liquid to be dispensed and a second control element for setting the type of liquid to be dispensed.

The invention further relates to a sanitary system comprising a sanitary fitting and a treatment device connected to the sanitary fitting for providing treated liquid.

The invention further relates to a method of operating a sanitary fitting.

2. Description of the Related Art

Sanitary fittings have become known in a variety of ways. Known sanitary fittings have, for instance, a fitting body having at least one control element for setting at least one characteristic of a fluid flow routed through the sanitary fitting. The property may be, for instance, the flow rate of the fluid flow or the temperature of the fluid flow. In known sanitary fittings, for instance, the fluid flow is mixed from a separate cold-water flow and hot-water flow by means of a mixing device, and from there it is routed to an outlet.

To increase functionality, for instance, a sanitary fitting has become known from DE 10 2013 000 773 A1 or DE 10 2013 002 236 A1 having at least one first actuating element for setting the temperature and/or quantity of mixed water and having at least one second actuating element for setting the quantity of hot water. The second actuating element, which can be used to adjust the amount of hot water, is designed as a rotary selector switch. It must first be turned in a first direction to activate the hot water function. Then, it must be turned in the direction opposite to the first direction to set the desired amount of hot water.

From DE 10 2019 210 435 A1, a sanitary fitting for dispensing treated liquids, in particular for beverages, is known, comprising a first control element for setting the quantity of the treated liquid to be dispensed and a control element for providing the quantity of treated liquid set by means of the first actuating element, wherein at least one second control element is arranged for selecting a type of treatment, in particular of at least two different types of treatment, from untreated liquid, wherein the first and the at least one second control element can be actuated independently of each other. Furthermore, an annular display device is arranged, which can be used to display various colored representations, for instance the colors red, white, green, yellow and/or orange. The display device can also display the color intermittently, in other words provide flashing in the respective colors.

The disadvantage thereof is that only limited and inadequate feedback information or feedback about the position of the control elements or the processing device can be provided to a user. Feedback to the user is based only on single optical signals or colors, which is only possible to a limited extent because of the large number of types of treatment of liquids, states of the sanitary fitting and components of the latter, in particular a treatment device, etc.

Therefore, this invention addresses the problem of providing a sanitary fitting, a sanitary system, and a method of operating a sanitary fitting, which provide increased flexibility with respect to the display while being simple to manufacture and operate.

SUMMARY OF THE INVENTION

In an embodiment, this invention solves the above-mentioned problems based on a sanitary fitting for dispensing treated liquids, comprising a first control element for setting a quantity of a liquid to be dispensed, a second control element for setting the type of liquid to be dispensed, a display device, which has a plurality of optical display elements, and a control device, which is connected, on the one hand, to the control element and/or to a treatment device and, on the other hand, to the display device, such that control element settings and/or at least one state of the treatment device is/are displayed by means of separate actuation of the optical display elements.

In an embodiment, this invention solves the problems above based on a sanitary system comprising a sanitary fitting, and a treatment device connected to the sanitary fitting for providing treated liquid, in particular wherein the treatment device comprises at least one of the devices listed below:

- a filter device for providing a filtered fluid, in particular filtered water,
- a carbonation device for providing a carbonated fluid, in particular carbonated water,
- a warming and/or heating device for providing fluids at high temperature, in particular hot water,
- a cooling device, in particular for providing a cooled fluid, in particular water,
- an ionization device for ionizing a fluid, in particular water,
- an enrichment device for enriching the fluid by adding at least one substance, in particular mineral substance, flavoring, coloring or the like,
- an add-on device for adding concentrates, in particular fruit juice concentrates or the like, to a fluid,
- a hygienic device for providing hygienically treated fluid, in particular for sterilizing a fluid, and/or
- a cleaning device (for providing a cleaning and/or rinsing medium instead of or to be added to a fluid, and wherein the control device is designed to display states of devices by means of a separate actuation of the optical display elements.

In an embodiment, this invention solves the problems listed above using a method for operating a sanitary fitting, comprising the steps

- setting, by means of a first control element, a quantity of a liquid to be dispensed,
- setting, by means of a second control element, the type of liquid to be dispensed, and
- displaying, by means of a display device, which has a plurality of optical display elements, of control element settings and/or at least one state of the treatment device by means of separate actuation of the optical display elements by means of a control device which is connected on the one hand to the control element and/or to the treatment device and on the other hand to the display device.

One of the advantages achieved in this way is that the display of sanitary fitting conditions and the corresponding feedback to a user of the sanitary fitting is greatly improved. Errors, states or events can be additionally and directly displayed to a user in this way, improving usability. Another advantage is the increased flexibility, since now a corresponding display can be made to a user almost independently of the number and states of components or positions of the actuating elements. Another advantage is that a simple and inexpensive implementation or a simple and inexpensive execution is rendered possible.

The term "treated liquid" shall be understood in the broadest sense and refers, in particular in the claims, preferably in the description, to liquids, in particular water in the form of tap water from a water supplier or the like, the properties and/or composition of which is additionally changed by a separate device. For instance, treated water may have a high temperature, so-called hot water, a different degree of carbonation, a partially different composition or the like for the water originally provided by the water supplier. The term "treated liquid" should in particular not be understood to denote hot or cold water, which is usually provided by a water supplier to a single-family house, multiple-family house or the like, and the temperature of which may be adjusted via a heating system or the like.

The term "type of treatment" shall be understood in the broadest sense and refers, in particular in the claims, preferably in the description, not only to the basic type of treatment of a liquid, for instance whether the water has been carbonated or not, but also to the degree, intensity or concentration of the treatment, for instance the intensity of carbonation. Different types of treatment shall thus be understood to denote, for instance, different degrees of carbonation, such as "still", "medium" or "classic". Different types of treatment also comprise different temperatures of hot water, water filtered to different degrees, different concentrations of flavor additives or flavorings, different types of mineralization, and different concentrations of the same type of mineralization or the like. The term "type of treatment" also includes, in particular, "non-treatment".

Further features, advantages and further embodiments of the invention are described below or may be disclosed in that way.

According to a preferred embodiment of the invention, the optical display elements, in particular each of the optical display elements, can display different colors. This further improves flexibility with regard to the display of different states, error messages and the like. For instance, every display element may be configured to display at least three different colors.

According to a further preferred embodiment of the invention, the control device is designed to display optical sequences by means of the optical display elements. The advantage thereof is that it further improves flexibility with regard to the representation of different states, error messages and the like.

According to a further preferred embodiment of the invention, an optical sequence in the form of flashing and/or intermittent display of colors can be provided. One of the advantages achieved is that, for instance, acute critical conditions can be quickly and easily displayed to a user.

According to a further preferred embodiment of the invention, the two control elements are arranged along a common axis on the sanitary fitting, in particular on the same side of the sanitary fitting. On the one hand, this saves installation space, while at the same time simplifying operation by one user.

According to a further preferred embodiment of the invention, the display device is arranged on the axis next to the two control elements or between the two control elements. The advantage of this is that the user can receive visual feedback directly when actuating the control elements by means of the optical display direction.

According to a further preferred embodiment of the invention, the display device comprises a plurality of partial display devices, which are arranged at a distance from one another, in particular on different axes of the sanitary fitting. One of the advantages thus achieved is improved user-friendliness and faster perceptibility and assignment of display device indications, because the respective partial display devices can be arranged directly on the respective components. For instance, when "hot water" is selected, a red lighted indicator may be located at the outlet or discharge to indicate that hot water is being dispensed, whereas the corresponding control element is located on the side of the fitting base body.

According to a further preferred embodiment of the invention, the display device is integrated in at least one of the control elements. In this way the installation space for the sanitary fitting can be reduced overall.

According to a further preferred embodiment of the invention, the optical display device is at least one ring. In addition to a good visual appearance and better perceptibility by a user of the sanitary fitting, this also improves operability.

According to a further preferred embodiment of the invention, the display device comprises more than 6 and less than 30 display elements, in particular more than 12 and less than 24, preferably more than 15 and less than 20, in particular 18 display elements. This allows for a sufficient number of states to be displayed while keeping the manufacturing costs for the display elements low.

According to a further preferred embodiment of the invention, the control device is connected to the display device and/or the treatment device by wire or wirelessly. This means that, on the one hand, a high level of reliability can be provided in the case of a wired connection, and on the other hand, in the case of a wireless connection, a high level of flexibility can be achieved with regard to the arrangement of the control and display device and/or treatment device in relation to each other.

According to a further preferred embodiment of the invention, the display device and/or the control device has an interface, in particular a wireless interface, for configuring the display of the display device with respect to positions of the control elements. In this way, for instance, a user-specific display of various states can be provided. At the same time, the user experience is improved. It is also conceivable to alternatively or additionally provide the treatment device with a corresponding interface.

Further important features and advantages of the invention are described in more detail below, in the drawings, and in the accompanying figure description based on the drawings.

It should be understood that the features mentioned above and those to be explained below can be used not only in the combination indicated in each case, but also in other combinations or on their own, without departing from the scope of this invention.

BRIEF DESCRIPTION OF THE DRAWINGS

Preferred embodiments and embodiments of the invention are shown in the drawings and will be explained in more detail in the following description, wherein identical reference numerals refer to identical or similar or functionally identical components or elements.

In the Figures

DETAILED DESCRIPTION OF THE INVENTION

Figure 1:
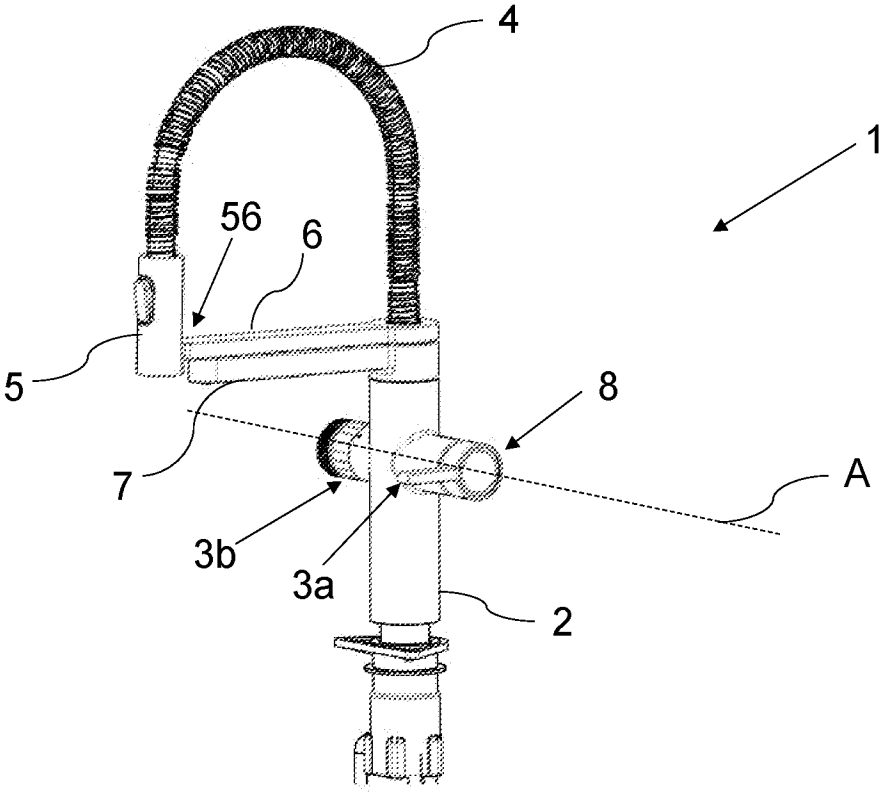
FIG. 1 shows a 3-dimensional view of a sanitary fitting according to an embodiment of this invention.

FIG. 1 shows a 3-dimensional view of a sanitary faucet according to an embodiment of this invention.

In detail, FIG. 1 shows a sanitary fitting 1 for kitchens. The sanitary fitting 1 is part of a sanitary system 200 of FIG. 3. The sanitary fitting 1 comprises a cylindrical fitting body 2, at which one control-element unit 3*a*, 3*b* each is arranged perpendicular to the cylinder axis, i.e., along the axis A, on different sides of the fitting body 2. Here, the first control-element unit 3*a* is used to adjust a mixed-water temperature and a flow rate of a mixed water based on untreated hot and cold water. For this purpose, the first control-element unit 3*a* comprises a single-lever mixing device 8. The second control-element unit 3*b*, which is described in more detail in FIG. 2 below, can be used to set a quantity and a treatment type for treated water and a dispensing of the treated quantity of water can be triggered.

A water outlet 5, to which mixed water can be applied, is further arranged on the fitting body 2 in a swiveling manner via an outlet arm 4. Furthermore, the water outlet 5 is connected to a retaining arm 6 via a detachable connection 56, wherein the retaining arm 6 in turn is arranged on the fitting body 2 to be swiveled in parallel to the cylinder axis of the fitting body 2. The detachable connection 56 can be established, for instance, by a magnetic force. A further water outlet 7 is arranged on the underside of the retaining arm 6, which can be used to dispense treated water, which can be adjusted by means of the second control-element unit 3*b*.

Figure 2:
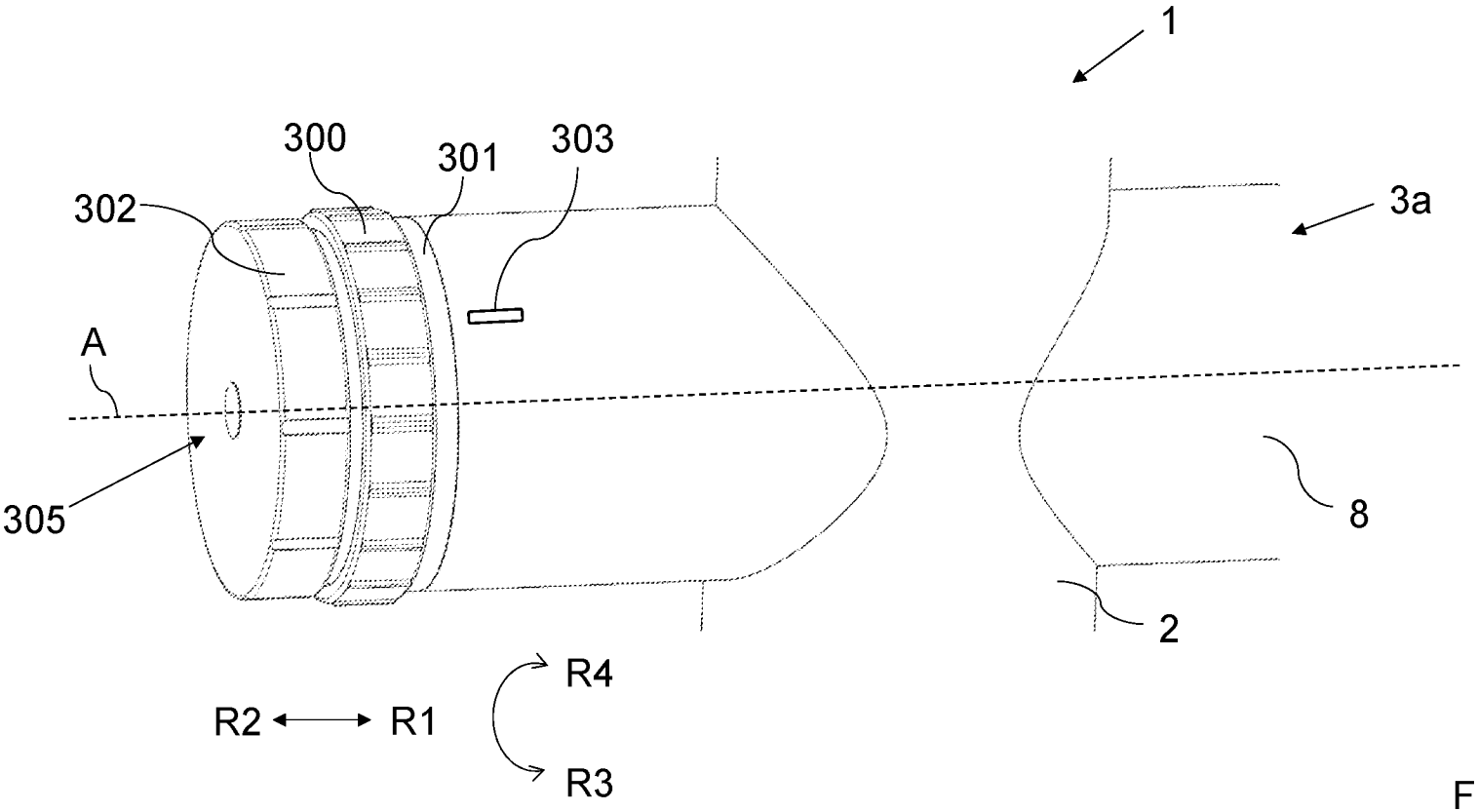
FIG. 2 shows a 3-dimensional section of the sanitary fitting according to FIG. 1.
Figure 3:
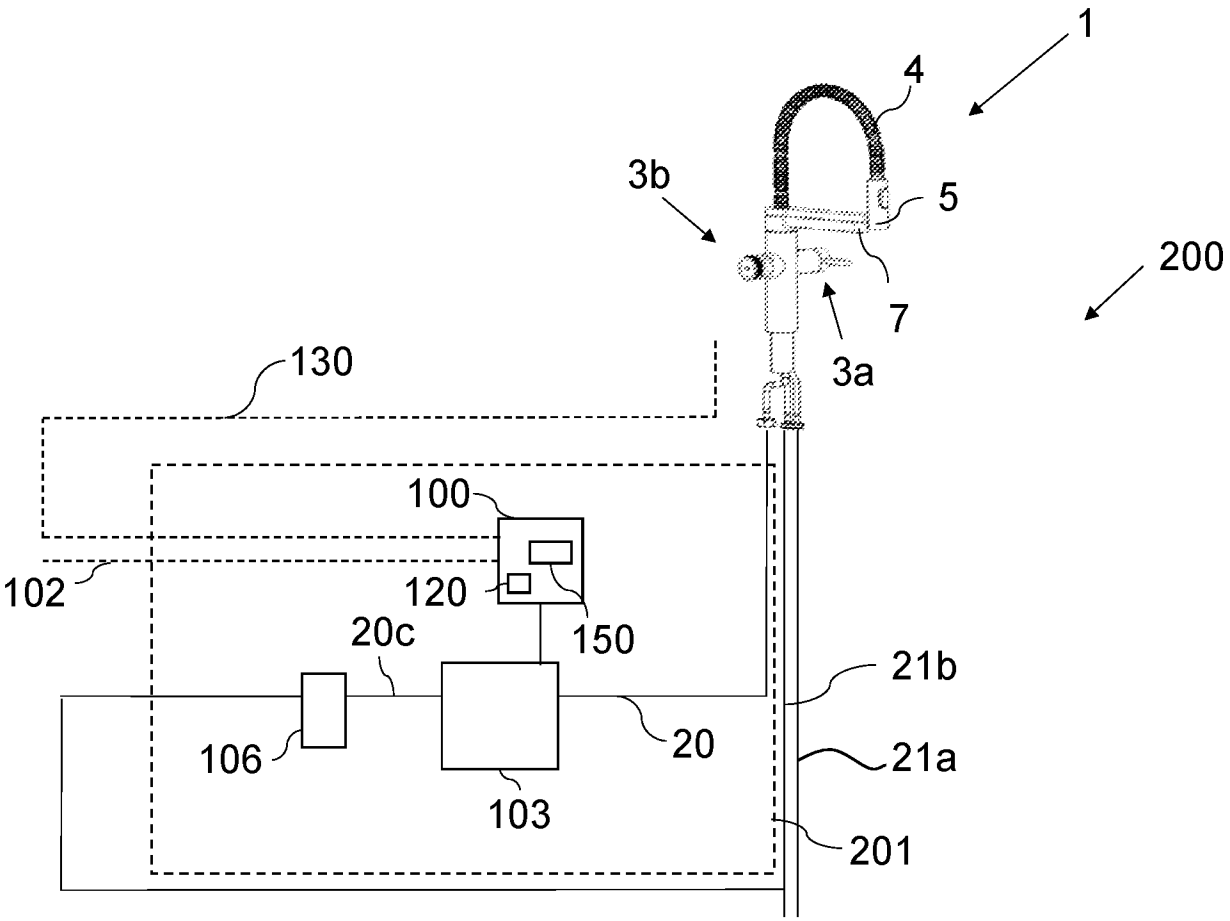
FIG. 3 shows a sanitary system according to an embodiment of this invention including a sanitary fitting according to FIG. 2.

FIG. 2 shows a three-dimensional section of the sanitary fitting according to FIG. 1 and FIG. 3 shows a sanitary system according to an embodiment of this invention having a sanitary fitting according to FIG. 2.

FIG. 2 shows essentially the second control-element unit 3*b* in detail. The second control-element unit 3*b* comprises a first control element 300 in the form of a ring rotatable about an axis A, which ring is arranged perpendicular to the axis of the cylindrical valve body 2. The first control element 300 is used to adjust the desired amount of treated water. For this purpose, the first control element can have visually and haptically perceptible elevations in the form of radial projections for defining different setting positions.

There is an indicator 301 along axis A in FIG. 2 to the right of the first control element 300 and, again to the right, a mark 303 indicating the position of the first control element 300. On the other hand, the marker 303 may also be configured as a second indicator device adjacent to a first indicator device 301. The first indicator 301 is arranged on the right side of the first control element 300 and on the left side of the marker 303, and is annular in shape. In this context, the first display device 301 comprises a total of 18 separately actuatable optical elements in the form of multi-colored LEDs. The first display device 301 can be used to display different color representations on the one hand, for instance at least the colors red, white, green, yellow and/or orange or the like, and on the other hand also different colors simultaneously, for instance the colors red and white alternately in the circumferential direction. The second display device 303 can also be used to display various luminous colors, in particular the colors red and blue. Each of the two display devices 301, 303 can also display the color intermittently, in other words provide flashing in the respective color. The first display device 301 can thus also display temporal sequences, for instance in this way a display of a red dot or band or section moving in the circumferential direction of the ring. The indicating devices 301, 303 may alternatively or additionally provide audible signals, such as an intermittent beeping or the like.

Furthermore, the second control-element unit 3*b* has a second control element 302, which is also annular in shape and is arranged to the left of the first control element 300. Like the first control element 300, the second control element 302 has a corrugation on its outer circumference to provide a user with a better grip. On the one hand, the second control element 302 is designed to be rotatable with directions of rotation R3, R4 about the axis A, and on the other hand, this control element is also arranged to be movable along the axis A in the axial direction R1, R2. On the surface of the second control element 302 there is a circular surface (not shown) with an actuating element 305 perpendicular to the axis A. The actuating element 305 is used to trigger the dispensing of treated water. The actuating element 305 can be designed to be actuated without contact or by means of contact. In this regard, the actuating element 305 may be in the form of an infrared sensor such that when the surface is touched, the actuating element 305 is triggered.

The second control element 302 can be moved to different snap positions by rotating it in the direction R4. Rotation in the opposite direction R3 may be permitted, but may not be permitted; then a user would only be able to continue rotating the second control element 302 in the direction R4. The second control element 302 is used to select the desired type of treated water. For this purpose, the second control element 302 can have visually and haptically perceptible elevations in the form of radial projections for defining different setting positions.

The operation of the sanitary fitting 1 will now be explained in detail. For this purpose, the sanitary fitting 1 is initially in idle/standby mode. This may be such that when the actuating element 305 is actuated in the standby mode, mixed water, in this case unfiltered tap water, is discharged through the water discharge 5. No additional actuation of the second control element 302 is required.

While the water is being dispensed, a running indication is given by means of nine LEDs—i.e., half a ring-towards the front (clockwise when looking at the surface along axis A). To this end, nine LEDs always light up simultaneously, the last LED is not actuated, the next LED is actuated. The speed of the sequence is chosen such that the half ring takes 2 seconds to circulate once completely.

If the actuating element 305 is actuated again during delivery, the dispensing of mixed water is aborted. If the actuating element 305 is not actuated again during the mixed water dispensing, the mixed water is discharged for 20 seconds and is then stopped. The value of 20 seconds can be set or changed via a corresponding App, for instance.

If the second control element 302 is actuated while the water is being dispensed, no action is taken. If the first control element 300 is actuated during dispensing, dispensing of water continues and/or stops after dispensing the set amount. After dispensing, the sanitary fitting 1 changes to the standby mode or, if necessary, to the corresponding mode specified by the second control element 302.

If the first control element 300 is set to a predefined quantity, in this case "0", i.e., to a certain predefined or predefinable quantity assigned to a shutdown of the sanitary fitting 1, the sanitary fitting 1 is turned off. The indicator 301 is disabled and the first control element 300 and second control element 302 are disabled, so that none of the water types or mixed water is output when the latter is actuated. Likewise, no errors or a cleaning program that may already be running are indicated by means of the display device. If a cleaning program was started prior to shutdown, it continues until its regular termination; however, no indication is given by means of the display device 301. The mixing device 8 on the right side of the sanitary fitting 1 can still be used to independently tap mixed water.

FIG. 3 shows a sanitary system 200 comprising a sanitary fitting 1 according to FIGS. 1 and 2 and a treatment device 201 and a control device 100 in detail. Specifically, a filter device 106 is arranged, which is connected to a cold-water line 21*b* for supplying cold water. The filter device 106 can then be used to provide filtered water via a line 20*c* connected to a processing device 103 and via a line 20 connected to the water outlet 7. For this purpose, for controlling the processing device 103 the control device 100 is connected to the processing device 103 by wire or wirelessly.

However, the processing device 103 may also be integrated into the control device 100.

The processing device 103 may comprise, for instance:

- the aforementioned filter device 106,
- a carbonation device for providing a carbonated fluid, in particular carbonated water,
- a warming and/or heating device for providing fluids at high temperature, in particular hot water,
- a cooling device, in particular for providing a cooled fluid, in particular water,
- an ionization device for ionizing a fluid, in particular water,
- an enrichment device for enriching the fluid by adding at least one substance, in particular mineral substance, flavoring, coloring or the like,
- an add-on device for adding concentrates, in particular fruit juice concentrates or the like, to a fluid,
- a hygienic device for providing hygienically treated fluid, in particular for sterilizing a fluid, and/or
- a cleaning device for providing a cleaning and/or rinsing medium instead of or to be added to a fluid.

The control device 100 is configured to determine when a filter cartridge of the filter device 106 needs to be changed. Further, a flow control unit, which includes a plurality of valves (not shown), may be provided.

The control device 100 is connected to the two control elements 300, 302, the display device 301, and to the actuating element 305 for the corresponding control or actuation thereof via a signal line 130. The control device 100 is further connected to a power supply 102 for its operation. Treated liquid, for instance filtered water, or if a hot-water system is provided, hot water, can be dispensed via the line 20 through the water discharge 7. The hot-water line 21*a* and the cold-water line 21*b* are connected to the first water discharge 5 via the first control-element unit 3*a* having a mixer cartridge, and mixed water having a corresponding temperature can be discharged therethrough accordingly. The control device 100 may further include or be connected to an interface 150 for communication, programming, and/or configuration of the control device 100.

If the first control element 300 is set to "0", the components of the treatment device 201 continue to operate, for instance the heating device.

When a particular position is set by the second control element 302, one of the display elements lights up in the corresponding color (for instance, blue for the selection of "Classic sparkling"). The water types and quantities are directly assigned at the control device 100, which may have a screen for this purpose, or by means of the App.

When the second control element 302 is actuated and then the actuating element 305 is actuated, the set type and amount of water is dispensed. While the water is being dispensed, a running indication is given by means of nine LEDs—i.e., half a ring-towards the front (clockwise when looking at the surface along axis A). To this end, nine LEDs always light up simultaneously, the last LED is not actuated, the next LED is actuated. The speed of the sequence is chosen such that the half ring takes 2 seconds to circulate once completely.

If the selection "boiling water" is stored at a certain position, one of the display elements of the display device 301 is red. However, a safety device must first be overcome here by pressing and rotating the second control element 302 through a predetermined angle before the hot water can be tapped through the confirmation element 305. If the actuating element 305 is actuated again during the dispensing of the hot water, the hot water dispensing stops. If the second control element 302 is actuated during dispensing, the hot water is dispensed in the selected amount. If the first control element 300 is actuated during dispensing, dispensing is terminated after the selected quantity has been dispensed. After dispensing, the sanitary fitting 1 changes to the standby mode, however, or, if necessary, to the corresponding mode specified by the second control element 302.

In order to dispense hot water, a safety barrier must be overcome—as explained above. To select boiling hot water, the second control element 302 has to be pushed in the direction of the first control element 301 along axis A and rotated backwards by at least 80°. A haptic feedback, in particular by means of a grid, reports the correct, i.e., sufficient, angle of rotation back to a user. The hot water mode is indicated by the red color of all display elements of the display device 301.

After the hot water mode has been activated, after one second the entire display device 301 is turned off and only a red illuminated display element can be seen at the position of the mark 303. The first control element 300 can then optionally be used to change the selected quantity by rotating it.

Touching the actuating element 305, particularly in the form of an infrared sensor, generally triggers the dispensing of water. Renewed pressing stops the dispensing of water, even if the set quantity has not yet been reached. While the water is being dispensed, a running indication is given by means of nine LEDs—i.e., half a ring-towards the front (clockwise when looking at the surface along axis A). To this end, nine LEDs always light up simultaneously, the last LED is not actuated, the next LED is actuated. The speed of the sequence is chosen such that the half ring takes 2 seconds to circulate once completely.

To indicate the status of the filter device 106, in standby mode, when the filter device of the sanitary system 200 has a remaining filter time below a presettable threshold, a yellow indicator element comes on below the white indicator element.

The yellow display element is turned off only

- when the water type is selected, when the entire display device lights up,
- when an error is active and the entire display device pulses red, when the fitting is switched off, or when the cleaning program is running.

In standby mode of the sanitary fitting 1, if the residual filter time is below a predefinable threshold value and if the $CO_2$ pressure sensor detects less than a predefinable pressure value, for instance below 3 bar, a red indicator element comes on below the white indicator element.

The red display element is only turned off when the water type is selected, when the entire display device lights up, when an error is active and the entire display device pulses red, when the fitting is switched off, or when the cleaning program is running.

If a cleaning program has been started via the display 120 of the control device 200 or via the App, nine yellow display elements show a running indication, here in the form of LEDs—i.e., half a ring-towards the front (clockwise when viewed from the direction of the surface along axis A). To this end, nine LEDs always light up simultaneously, the last LED is not actuated, the next LED is actuated. The speed of the sequence is chosen such that the half ring takes 2 seconds to circulate once completely.

If the user has to take active action during the cleaning program, such as replacing a cleaning cartridge, removing a cleaning cartridge, or the like, all of the display elements of the display device pulse yellow and the action to be taken is visualized on the display 120 of the control device 100. If the cleaning program continues to run, a running indication is given by means of nine yellow illuminated display elements. At the end of the cleaning program, the sanitary system 200 returns to standby mode.

If an error has occurred in the sanitary system 200 or if a control menu is activated on the display 120 of the control device 200, the entire LED ring will pulse red; the sanitary system 200 is now in error mode. In that case, no adjustment can be made via the two control elements 300, 302, and the control element 305 is switched off. Error mode is an interrupt to any other state and interrupts all operations; an active dispensing of water is canceled in the event of an error or of the activation of the menu on the display. An active error during the cleaning program temporarily disables the sanitary system.

When the second control element 302 is actuated in standby, all of the display elements of the display device 301 display the appropriate color according to the desired type of treatment, and the type of treated water can be selected. When the second control element 302 is rotated forward (clockwise as viewed from the actuating element), the water type changes the color of the indicator 301 from green, light blue to blue at each notch. There, green denotes still water, light blue medium sparkling and blue classic sparkling. When turning in the other direction, the order is reversed. After the actuating element 305 have been actuated, the complete display device 301 lights up for 1 second in the selected color. After this second, only one LED is displayed at marker 303 in the selected color.

To select the "Classic sparkling" water type, proceed as follows:

After the water type "Classic sparkling" has been selected by means of the second setting element 302, the entire LED illuminated ring is turned off and only one display element in the color of the desired water type lights up at the point-here blue—where the selected quantity is set. The first control element 300 can then be used to optionally change the selected quantity by rotation. For instance, thirteen preset volume settings are available (100-1000 ml). In addition, a further four individually definable water quantities can also be provided.

Touching the actuating element 305 triggers the dispensing of water. As long as the desired water is dispensed, nine LEDs—i.e., half a ring-give a running indication as described above. To this end, nine LEDs always light up simultaneously, the last LED is not actuated, the next LED is actuated. The speed of the sequence is chosen such that the half ring takes 2 seconds to circulate once completely.

After tapping the desired water, the sanitary fitting 1 remains in the selected setting for 5 seconds and an indicator element of the display device 301 lights up in the corresponding color. It can now be tapped again or the settings can be changed, for instance, the quantity can be changed. After the specified time period has elapsed, in this case 5 seconds, the sanitary fitting 1 returns to standby mode. In standby mode, the one display element of the display device 301 lights up white again. If an individual quantity is set, then a display element of the display device 301 indicates the defined water type by means of the assigned color.

Figure 4:
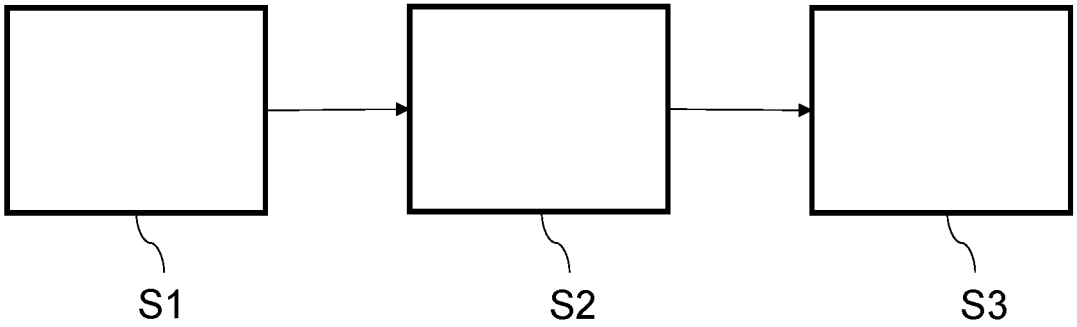
FIG. 4 shows a method for operating a sanitary fitting according to an embodiment of this invention.

FIG. 4 shows a method for operating a sanitary fitting according to an embodiment of this invention.

In detail, FIG. 4 shows steps of a method for operating a sanitary fitting according to an embodiment of this invention.

The method comprises the steps outlined below:

setting S1, by means of a first control element, a quantity of a liquid to be dispensed, setting S2, by means of a second control element, the type of water to be dispensed, and displaying S3, by means of a display device, which has a plurality of optical display elements, control element settings by means of separate actuation of the optical display elements by means of a control device, which is connected on the one hand to the control elements and on the other hand to the display device.

In summary, at least one of the embodiments of the invention has at least one of the advantages listed below:

superior user experience.

high flexibility regarding the display of states of the sanitary fitting.

easy to manufacture and implement.

simple implementation.

reliable selection of treated water and error indication.

Although this invention has been described with reference to preferred exemplary embodiments, it is not limited thereto and can be modified in a variety of ways.

LIST OF REFERENCE NUMERALS AND TERMS

1 sanitary fitting
2 fitting body
3*a* first control-element unit
3*b* second control-element unit
4 outlet arm
5 water outlet
6 retaining arm
7 water outlet
8 mixing device
20 line
20*a* line
20*b* line
20*c* line
21*a* hot-water line
21*b* cold-water line

56 detachable connection
100 control device
102 power supply
103 processing device
106 filter device
120 display
130 signal line
150 interface
200 sanitary system
201 treatment device
300 first control element
301 first display device
302 second control element
303 marking/second display device
305 actuating element
A axis
R1, R2 axial direction
R3, R4 direction of rotation
S1-S3 steps of a method

The invention claimed is:

1. A sanitary system comprising:
a sanitary faucet; and
a control device,
wherein:
the sanitary faucet includes: (i) a first control element for setting a quantity of a liquid to be dispensed; (ii) a second control element for setting a type of the liquid to be dispensed; and (iii) a display device including optical display elements; and
the control device is connected to the first control element, the second control element and the display device; and
the control device is programmed to control the display device to display control element settings by separate actuation of the optical display elements.

2. The sanitary system of claim 1, wherein the optical display elements are configured to display different colors.

3. The sanitary system of claim 1, wherein the control device is configured to control the display device to display optical sequences by the optical display elements.

4. The sanitary system of claim 3, wherein the display device is configured to display an optical sequence as a flashing or intermittent display of colors.

5. The sanitary system of claim 1, wherein the first control element and the second control element are arranged along a common axis on the sanitary faucet.

6. The sanitary system of claim 5, wherein the display device is arranged on the common axis next to the first control element and the second control element, or between the first control element and the second control element.

7. The sanitary system of claim 5, wherein the first control element and the second control element are arranged along a same side of the sanitary faucet.

8. The sanitary system of claim 1, wherein the optical display elements are arranged at a distance from each other.

9. The sanitary system of claim 8, wherein the optical display elements are arranged on different axes of the sanitary faucet.

10. The sanitary system of claim 1, wherein the display device is integrated in at least one of the first control element or the second control element.

11. The sanitary system of claim 1, wherein the display device includes at least one ring.

12. The sanitary system of claim 1, wherein a number of the optical display elements is more than six and less than thirty.

13. The sanitary system of claim 1, wherein the control device is connected to the display device by wire.

14. The sanitary system of claim 1, wherein the display device or the control device has an interface for configuring the display device with respect to positions of the first control element and the second control element.

15. The sanitary system of claim 1, further comprising a treatment device for treating the liquid to be dispensed, wherein the treatment device is connected to the sanitary faucet.

16. The sanitary system of claim 15, wherein the treatment device comprises:
a filter device;
a carbonation device;
a heating device;
a cooling device;
an ionization device;
an enrichment device;
a concentrate adding device;
a hygienic device; or
a cleaning device.

17. A method of operating the sanitary system of claim 1, the method comprising:
setting, by the first control element, the quantity of the liquid to be dispensed;
setting, by the second control element, the type of the liquid to be dispensed; and
controlling, by the control device, the display device to display the control element settings.

18. A sanitary system comprising:
a sanitary faucet;
a treatment device; and
a control device,
wherein:
the sanitary faucet includes: (i) a first control element for setting a quantity of a liquid to be dispensed; (ii) a second control element for setting a type of the liquid to be dispensed; and (iii) a display device including optical display elements; and
the control device is connected to the first control element, the second control element and the display device; and
the control device is programmed to control the display device to display at least one state of the treatment device by separate actuation of the optical display elements.

19. The sanitary system of claim 18, wherein the treatment device comprises:
a filter device;
a carbonation device;
a heating device;
a cooling device;
an ionization device;
an enrichment device;
a concentrate adding device;
a hygienic device; or
a cleaning device.

20. The sanitary system of claim 18, wherein the treatment device comprises:
a filter device;
a carbonation device;
a heating device;
a cooling device;
an ionization device;
an enrichment device;
a concentrate adding device;
a hygienic device; and
a cleaning device.

* * * * *